US007869999B2

(12) United States Patent
Amato et al.

(10) Patent No.: US 7,869,999 B2
(45) Date of Patent: Jan. 11, 2011

(54) SYSTEMS AND METHODS FOR SELECTING FROM MULTIPLE PHONECTIC TRANSCRIPTIONS FOR TEXT-TO-SPEECH SYNTHESIS

(75) Inventors: Christel Amato, Bazainville (FR); Hubert Crepy, Boulogne (FR); Stephane Revelin, Saint Mande (FR); Claire Waast-Richard, Vélizy-Villacoublay (FR)

(73) Assignee: Nuance Communications, Inc., Burlington, MA (US)

( * ) Notice: Subject to any disclaimer, the term of this patent is extended or adjusted under 35 U.S.C. 154(b) by 749 days.

(21) Appl. No.: 11/200,808

(22) Filed: Aug. 10, 2005

(65) Prior Publication Data

US 2006/0041429 A1 Feb. 23, 2006

(30) Foreign Application Priority Data

Aug. 11, 2004 (EP) ..... 04300531

(51) Int. Cl.
*G10L 13/08* (2006.01)

(52) U.S. Cl. ..... 704/260; 704/258; 704/E13.002; 704/E13.012

(58) Field of Classification Search ..... 704/260, 704/258, E13.002, E13.012
See application file for complete search history.

(56) References Cited

U.S. PATENT DOCUMENTS 5,682,501 A * 10/1997 Sharman ..... 704/260
5,740,320 A * 4/1998 Itoh ..... 704/267
5,796,916 A * 8/1998 Meredith ..... 704/258
6,148,285 A * 11/2000 Busardo ..... 704/260
6,163,769 A * 12/2000 Acero et al. ..... 704/260
6,173,263 B1 * 1/2001 Conkie ..... 704/260
6,178,402 B1 * 1/2001 Corrigan ..... 704/259
6,230,131 B1 * 5/2001 Kuhn et al. ..... 704/266
6,363,342 B2 * 3/2002 Shaw et al. ..... 704/220
6,366,883 B1 * 4/2002 Campbell et al. ..... 704/260
6,665,641 B1 * 12/2003 Coorman et al. ..... 704/260
6,684,187 B1 * 1/2004 Conkie ..... 704/260
6,950,798 B1 * 9/2005 Beutnagel et al. ..... 704/260
6,961,704 B1 * 11/2005 Phillips et al. ..... 704/268
6,988,069 B2 * 1/2006 Phillips ..... 704/258
7,013,278 B1 * 3/2006 Conkie ..... 704/260
7,277,851 B1 * 10/2007 Henton ..... 704/235
7,333,932 B2 * 2/2008 Hain ..... 704/258

(Continued)

OTHER PUBLICATIONS

Jelinek, Frederick. 1976. Continuous speech recognition by statistical methods. IEEE. 532-556.*

(Continued)

*Primary Examiner*—Talivaldis I Smits
*Assistant Examiner*—Greg A Borsetti
(74) *Attorney, Agent, or Firm*—Wolf, Greenfield & Sacks, P.C.

(57) ABSTRACT

A system and method for generating synthetic speech, which operates in a computer implemented Text-To-Speech system. The system comprises at least a speaker database that has been previously created from user recordings, a Front-End system to receive an input text and a Text-To-Speech engine. The Front-End system generates multiple phonetic transcriptions for each word of the input text, and the TTS engine uses a cost function to select which phonetic transcription is the more appropriate for searching the speech segments within the speaker database to be concatenated and synthesized.

19 Claims, 5 Drawing Sheets

U.S. PATENT DOCUMENTS

| | | | | |
|---|---|---|---|---|
| 7,496,498 | B2 * | 2/2009 | Chu et al. | 704/4 |
| 7,630,898 | B1 * | 12/2009 | Davis et al. | 704/266 |
| 2002/0077820 | A1 * | 6/2002 | Simpson | 704/260 |
| 2002/0099547 | A1 * | 7/2002 | Chu et al. | 704/260 |
| 2002/0103648 | A1 * | 8/2002 | Case et al. | 704/260 |
| 2003/0069729 | A1 * | 4/2003 | Bickley et al. | 704/236 |
| 2003/0130848 | A1 * | 7/2003 | Sheikhzadeh-Nadjar et al. | 704/260 |
| 2003/0158734 | A1 * | 8/2003 | Cruickshank | 704/260 |
| 2003/0163316 | A1 * | 8/2003 | Addison et al. | 704/260 |
| 2003/0191645 | A1 * | 10/2003 | Zhou | 704/260 |
| 2004/0024600 | A1 * | 2/2004 | Hamza et al. | 704/268 |
| 2004/0111266 | A1 * | 6/2004 | Coorman et al. | 704/260 |
| 2004/0153324 | A1 * | 8/2004 | Phillips | 704/277 |
| 2004/0193398 | A1 * | 9/2004 | Chu et al. | 704/3 |
| 2005/0182629 | A1 * | 8/2005 | Coorman et al. | 704/266 |
| 2005/0197838 | A1 * | 9/2005 | Lin et al. | 704/260 |
| 2006/0031069 | A1 * | 2/2006 | Huang et al. | 704/243 |

OTHER PUBLICATIONS

M. Lee, D.P. Lopresti, and J.P. Olive, "A Text-to-Speech Platform for Variable Length Optimal Unit Searching Using Perceptual Cost Functions," Proc. ISCA Research Workshop Speech Synthesis, pp. 347-356, Aug.-Sep. 2001.*

Abhinav Sethy, Shrikanth Narayanam, "Refined speech segmentation for concatenative speech synthesis," Proc. ICSLP, pp. 145-148,2002.*

A. Hunt and A. Black, "Unit selection in a concatenative speech synthesis system using large speech database," in Proc. IEEE Int. Conf. Acoust., Speech, Signal Processing, 1996, pp. 373-376.*

Yeon-Jun Kim and Ann Syrdal. 2004. Improving tts by higher agreement between predicted versus observed pronunciations. In Fifth ISCA ITRW on Speech Synthesis (SSW5), Pittsburgh, PA, USA.*

Kim et al. "Pronunciation Lexicon Adaptation for TTS Voice Building", Oct. 4-8, 2004.*

Fackrell et al. "Improving the accuracy of pronunciation prediction for unit selection TTS", 2003.*

Rutten et al. "The application of interactive speech unit selection in TTS systems", 2003.*

Toda et al. "Optimizing Integrated Cost Function for Segment Selection in Concatenative Speech Synthesis Based on Perceptual Evaluations" 2003.*

Peng et al. "Perpetually Optimizing the Cost Function for Unit Selection in a TTS System With One Single Run of MOS Evaluation" 2002.*

Hamza et al. "Reconciling Pronunciation Differences Between the Frontend and Back-End in the IBM Speech Synthesis System" Oct. 2004.*

Crepy, H., et al., "Optimisation d'arbres de decision pour la conversion graphemes-phonemes", Proc. of XXIVemes Journees d'Etude sur la Parole, Nancy, (2002).

* cited by examiner

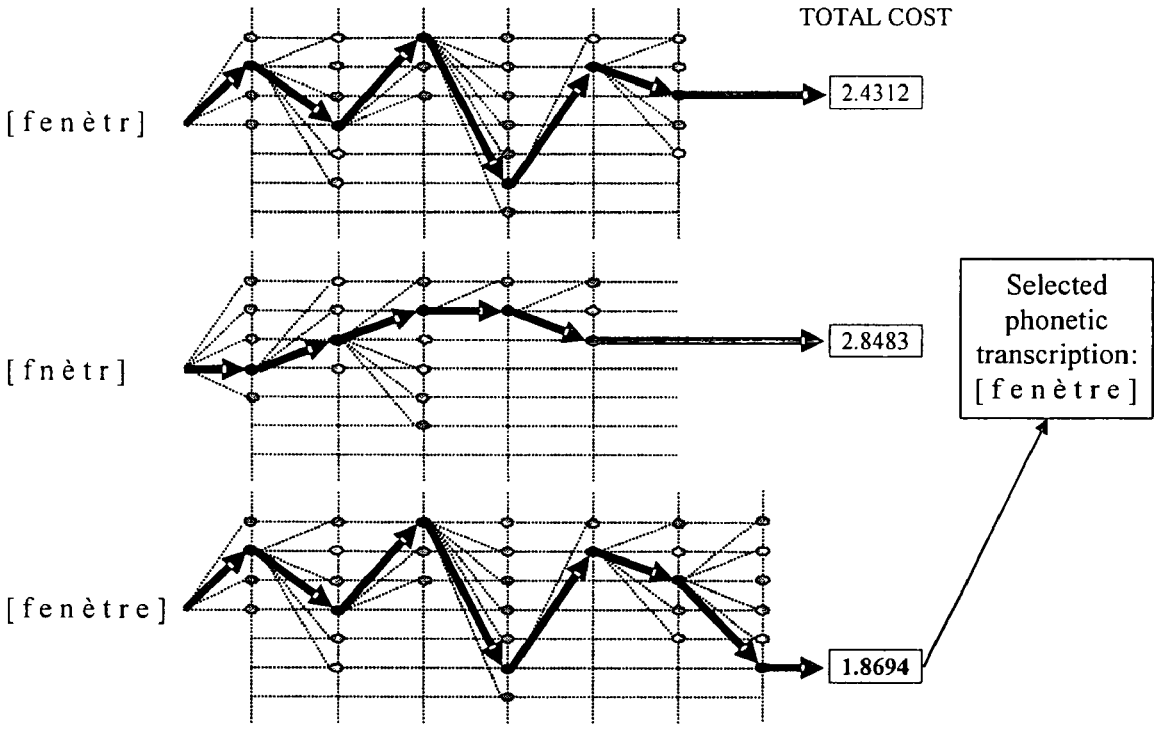
Figure 4-a
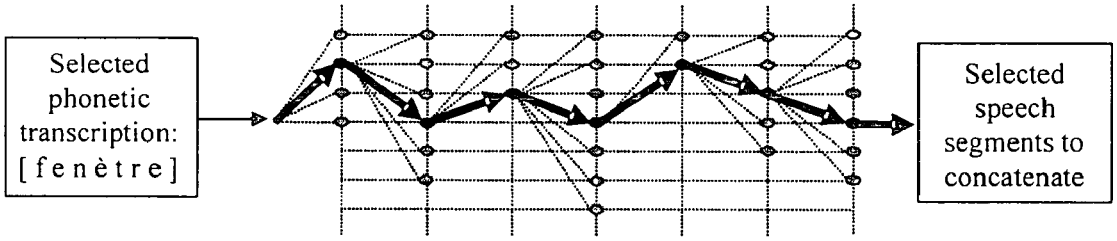
Figure 4-b

SYSTEMS AND METHODS FOR SELECTING FROM MULTIPLE PHONECTIC TRANSCRIPTIONS FOR TEXT-TO-SPEECH SYNTHESIS

CROSS-REFERENCE TO RELATED APPLICATIONS

This application claims the benefit of European Patent Application No. EP04300531.3 filed Aug. 11, 2004.

Field of the Invention

The present invention relates generally to a speech processing system and method, and more particularly to a text-to-speech (TTS) system based upon concatenative TTS technology.

Background of the Invention

Text-To-Speech (TTS) systems generate synthetic speech that simulates natural speech from text based input. TTS systems based on concatenative technology usually comprise three components: a Speaker Database, a TTS Engine and a Front-End.

The Speaker Database is firstly created by recording a large number of sentences or phrases that are uttered by a speaker, which can be referred to as speaker utterances. Those utterances are transcribed into elementary phonetic units that are extracted from the recordings as speech samples (or segments) that constitute the speaker database of speech segments. It is to be appreciated that each database created is speaker-specific.

The Front-End that is generally based on linguistic rules and is the first component used at runtime. It takes an input text and normalizes it to generate through a phonetizer one phonetic transcription for each word of the input text. It is to be appreciated that the Front-End is speaker independent.

The TTS engine then selects for the complete phonetic transcription of the input text, extracts the appropriate speech segments from a speaker database, and concatenates the segments to generate synthetic speech. The TTS engine may use any of the available speaker databases (or voices), but only one may be used at a time.

As mentioned above, the Front-End is speaker independent and generates the same phonetic transcriptions even if databases of speech segments from different speakers (i.e. different "voices") are being used. But in reality, speakers (even professional ones) do differ in their way of speaking and pronouncing words, at least because of dialectal or speaking style variations. For example, the word "tomato" may be pronounced [tom ah toe] or [tom hey toe].

Current Front-End systems predict phonetic forms using speaker-independent statistical models or rules. Ideally, the phonetic forms output by the Front-End should match the speaker's pronunciation style. Otherwise, the target phonetic forms prescribed by the Front-End fail to have corresponding "good" matches for the target forms, where the matches can be found in the speaker database. The results of a lack of "good" matches can be a degraded output signal or output that lacks humanistic audio characteristics.

In the case of a rule-based Front-End, the rules are in most cases created by expert linguists. For speaker adaptation, each time a new voice (i.e. a TTS system with a new speaker database) is created, the expert would have to manually adapt the rules to the speaker's speaking style. This may be very time consuming.

In the case of a statistical Front-End, a new one dedicated to the speaker must be trained, which is also time consuming.

Thus, the current speaker-independent Front-End systems force pronunciations which are not necessarily natural for the recorded speakers. Such mismatches have a very negative impact on the final signal quality, by causing excessive amounts of concatenations and signal processing adjustments.

Thus it would be desirable to have a Text-To-Speech system that does not impact the quality of the final signal due to mismatches between the Front-End phonetic transcriptions and the recorded speech segments.

SUMMARY OF THE INVENTION

Accordingly, the invention aims to provide a Text-To-Speech system and to achieve a method which improves the quality of the synthesized speech generated, by reducing the number of artifacts between speech segments, thereby saving processing and minimizing consumed processing resources.

In one embodiment, the invention relates to a Text-To-Speech system comprising a means for storing a plurality of speech segments, a means for creating a plurality of phonetic transcriptions for each word of an input text, and a means coupled to the storing means and to the creating means for selecting preferred phonetic transcriptions by operating a cost function on the plurality of speech segments.

In a preferred arrangement, the invention operates in a computer implemented Text-To-Speech system comprising at least a speaker database that has been previously created from user recordings, a Front-End system to receive an input text and a Text-To-Speech engine. Particularly, the Front-End system generates multiple phonetic transcriptions for each word of the input text, and the TTS engine is using a cost function to select which phonetic transcription is the more appropriate for searching the speech segments within the speaker database to be concatenated and synthesized.

To summarize, when a sequence of phones is prescribed by the Front-End, there are different sequences of speech segments that can be used to synthesize this phonetic sequence, i.e. several hypotheses. The TTS engine selects the appropriate segments by operating a dynamic programming algorithm which scores each hypothesis with a cost function based on several criteria. The sequence of segments which gets the lowest cost is then selected. When the phonetic transcription provided by the Front-End to the TTS engine at runtime matches well with the recorded speaker's pronunciation style, it is easier for the engine to find a matching segment sequence in the speaker database. There is less signal processing required to smoothly splice the segments together. In this setup, the search algorithm evaluates several possibilities of phonetic transcription for each word instead of only one, and then computes the best cost for each possibility. In the end, the chosen phonetic transcription will be the one which yields the lowest concatenative cost. For example, the Front-End may phonetize "tomato" into the two possibilities [tom ah toe] or [tom hey toe]. The one that matches the recorded speaker's speaking style is likely to bear a lower concatenation cost, and will therefore be chosen by the engine for synthesis.

In another embodiment, the invention relates to a method for selecting preferred phonetic transcriptions of an input text in a Text-To-Speech system. The method comprises the steps of storing a plurality of speech segments, creating a plurality of phonetic transcriptions for each word of an input text, computing a cost score for each phonetic transcription by operating a cost function on the plurality of speech segments, and sorting the plurality of phonetic transcriptions according to the computed cost scores.

In a further embodiment of the invention, a computer system for generating synthetic speech comprises:

(a) a speaker database to store speech segments;

(b) a front-end interface to receive an input text made of a plurality of words;

(c) an output interface to audibly output the synthetic speech; and (d) computer readable program means executable by the computer for performing actions, including:

(i) creating a plurality of phonetic transcriptions for each word the input text;

(ii) computing a cost score for each phonetic transcription by operating a cost function on the plurality of speech segments; and (iii) sorting the plurality of phonetic transcriptions according to the computed cost scores.

In a commercial form, the computer readable program means is embodied on a program storage device that is readable by a computer machine.

BRIEF DESCRIPTION OF THE DRAWINGS

The above and other objects, features and advantages of the invention will be better understood by reading the following more particular description of the invention in conjunction with the accompanying drawings wherein:

FIGS. 4-*a* and 4-*b* exemplify the preferred segments selection in a first-pass approach;

DETAILED DESCRIPTION OF THE INVENTION

Figure 1:
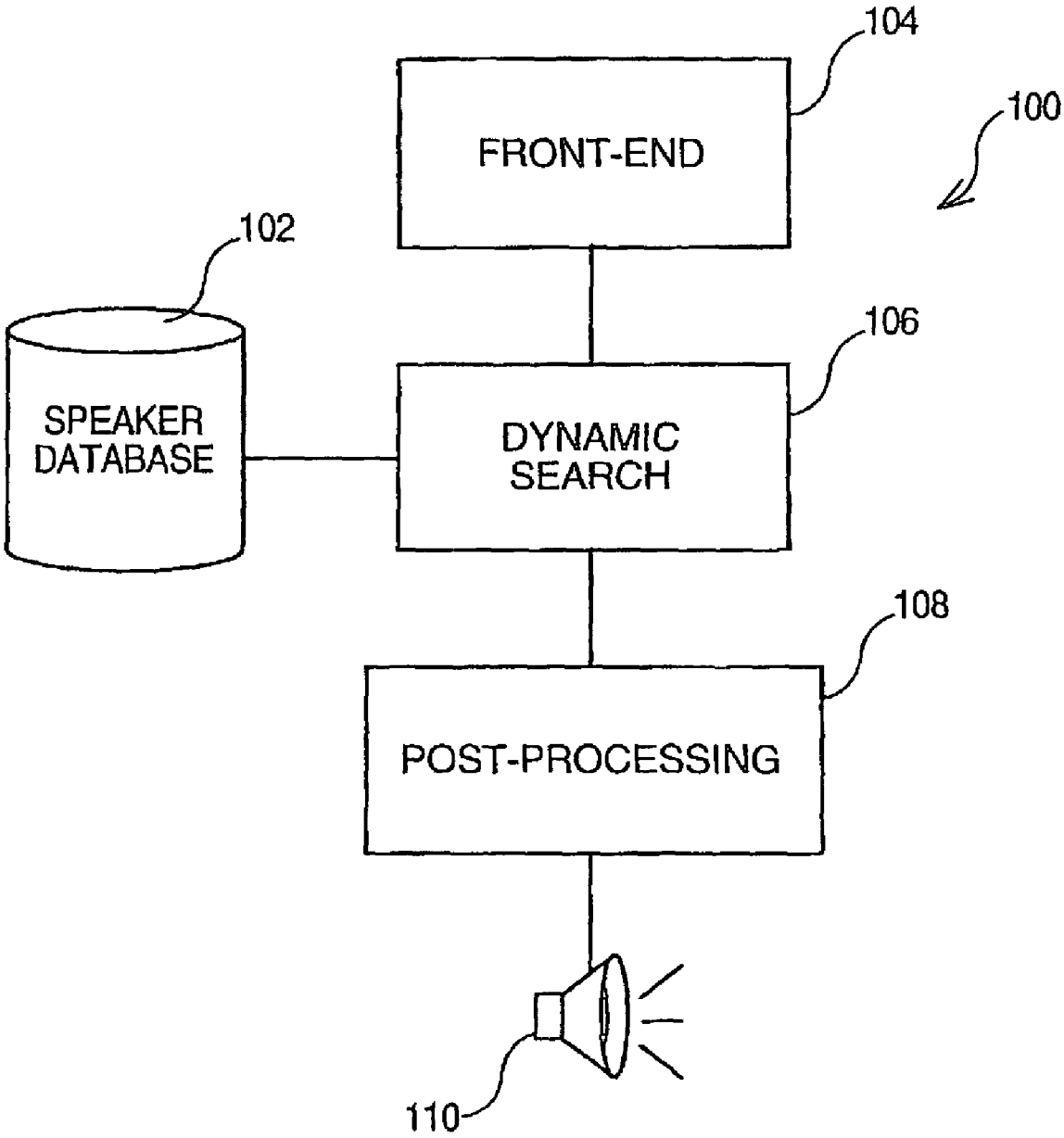
FIG. 1 is a general view of the system of the present invention.

An exemplary Text-To-Speech (TTS) system according to the invention is illustrated in FIG. 1. The general system 100 comprises a speaker database 102 to contain speaker recordings and a Front-End block 104 to receive an input text. A cost computational block 106 is coupled to the speaker database and to the Front-End block to operate a cost function algorithm. A post-processing block 108 is coupled to the cost computational block to concatenate the results issued from the cost computational block. The post-processing block is coupled to an output block 110 to produce a synthetic speech.

The TTS system preferably used by the present invention is a concatenative technology based system. It requires a speaker database built from the recordings of one speaker. However, without limitation of the invention, several speakers can record sentences to create several speaker databases. In application, for each TTS system, the speaker database will be different but the TTS engine and the Front-End engine will be the same.

However, different speakers may pronounce a given word in different ways, even in a specific context. In the following two examples, the word "tomato" may be pronounced [tom ah toe] or [tom hey toe] and the French word "fenêtre" may be pronounced [f e n è t r e] or [f e n è t r] or [f n è t r]. If the Front-End predicts the pronunciation [f e n èt r] while the recorded speaker has always pronounced [f n è t r], then it will be difficult to find the missing [e] in this context for this word in the speaker database. On the other hand, if the speaker has used both pronunciations, it could be useful to choose one or the other depending on other constraints which can be different from one sentence to another. The Front-End then provides multiple phonetic transcriptions for each word of the input text and the TTS engine will choose the preferred one when searching the speech segments recorded in order to achieve the best possible quality of the synthetic speech.

As already mentioned, the speaker database used in the TTS system of the invention is built in a usual way from a speaker recording a plurality of sentences. The sentences are processed to associate an appropriate phonetic transcription to each of the recorded words. Based on the speaker's speaking style, the phonetic transcriptions may differ for each occurrence of the same word. Once the phonetic transcription of every recorded word is complete, each audio file is divided into units (so-called speech samples or segments) according to these phonetic transcriptions. The speech segments are classified according to several parameters such as the phonetic context, the pitch, the duration or the energy. This classification constitutes the speaker database from which the speech segments will be extracted by the cost computational block 106 during runtime as will be explained later and then will be concatenated within the post-processing block 108 to finally produce synthetic speech within the output block 110.

Figure 2:
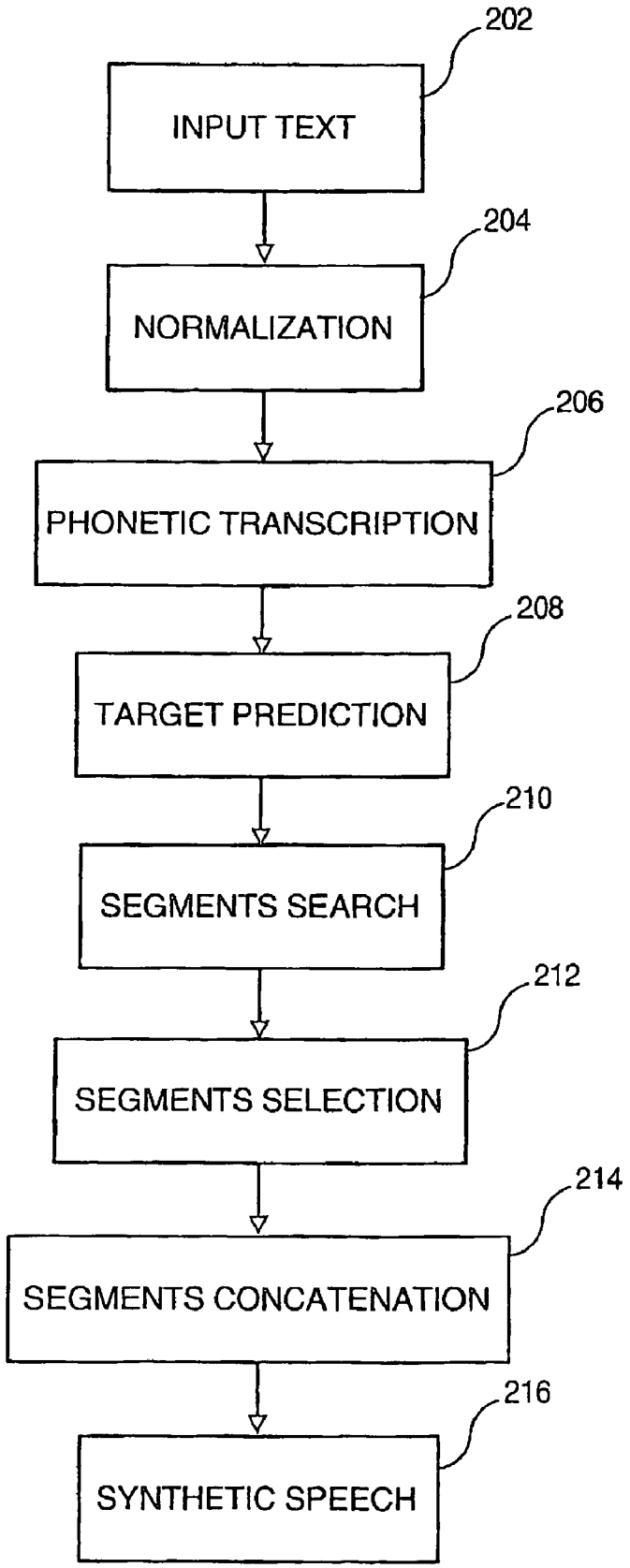
FIG. 2 is a flow chart of the main steps to generate a synthetic speech as defined by the present invention.

Referring now to FIG. 2, the main steps of the overall process 200 to issue an improved synthetic speech as defined by the present invention is described.

The process starts at step 202 with the reception of an input text within the Front-End block. The input text may be in the form of a user typing a text or of any application transmitting a user request.

At step 204, the input text is normalized in a usual way well known by those skilled in the art.

At the next step 206, several phonetic transcriptions are generated for each word of the normalized text. It is to be appreciated that the way the Front-End generates multiple phonetic forms is not critical as long as all the alternate forms are correct for the given sentence. Thus a statistical or rule-based Front-End may be indifferently used, or any Front-End based on any other methods. The person skilled in the art can find complete information on statistical Front-End systems in "Optimisation d'arbres de décision pour la conversion graphèmes-phonèmes", H. Crépy, C. Amato-Beaujard, J. C. Marcadet and C. Waast-Richard, Proc. of XXIVèmes Journées d'Étude sur la Parole, Nancy, 2002 and more complete information on rule-based Front-End systems in "Self-learning techniques for Grapheme-to-Phoneme conversion", F. Yvon, Proc. of the 2nd Onomastica Research Colloquim, 1994.

Whatever the Front-End system used, it has to disambiguate non-homophonic homographs by itself (e.g. "record" [r ey k o r d] and "record" [r e k o r d]) and it has to propose phonetic forms that are valid for the word usage in the sentence.

To illustrate this using the previous example of the word "fenêtre" which can be pronounced [f e n è t r e], [f e n è t r] or [f n è t r], depending on speaking style, the chosen Front-End block may generate these three phonetic forms.

By contrast, the French word "président" has two possible pronunciations depending on its grammatical class: [p r é z i d an] if it is a noun or [p r é z i d] if it is a verb. The choice of one or the other is totally depending on the sentence syntax. In this case the Front-End must not generate multiple phonetic transcription for the word "président".

At step 208, the Front-End produces a prediction of the overall pitch contour of the input text (and so incidentally produces the pitch values), the duration and the energy of the speech segments, the well-known prosody parameter. Doing so, the Front-End defines targeted features that will be then used by the search algorithm on next step 210.

Step 210 allows operation of a cost function for each phonetic transcription provided by the Front-End. A speech segment extraction is made, and given a current segment, this search algorithm aims to find the next best segments among those available, to be concatenated to the current one. This search takes into account the features of each segment and the targeted features provided by the Front-End. The search routine allows the evaluation of several paths in parallel as illustrated in FIG. 3.

Figure 3:
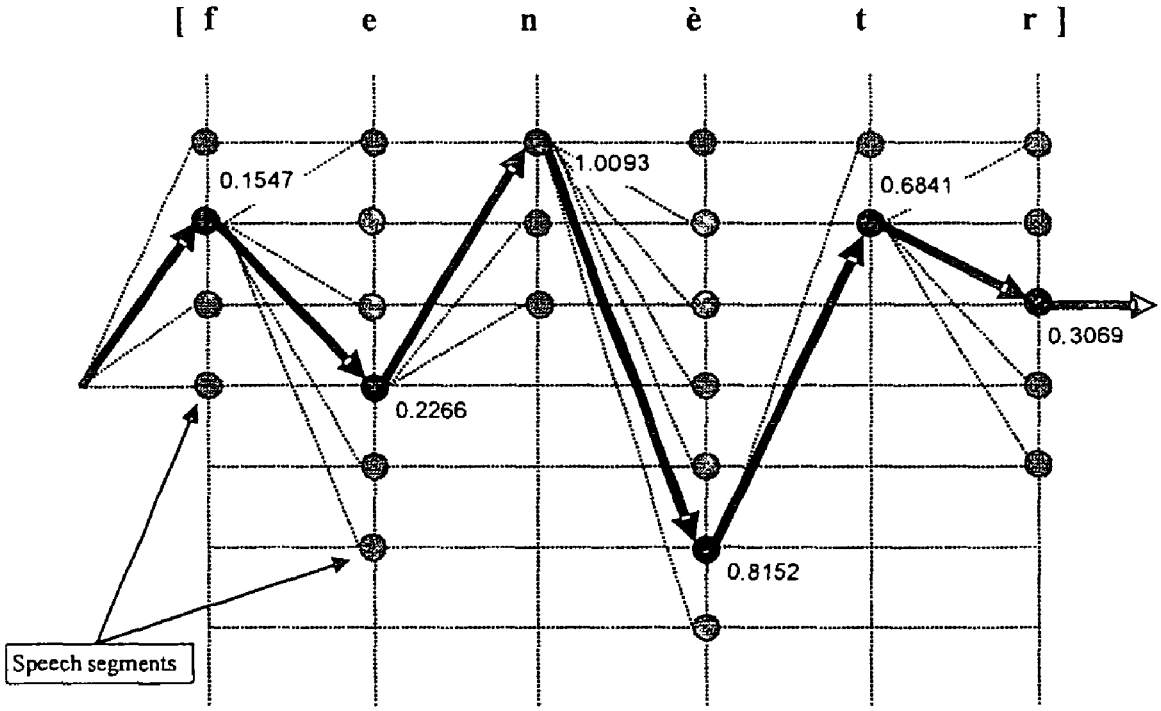
FIG. 3 shows an illustrative curve of the cost function.
Figure 5:
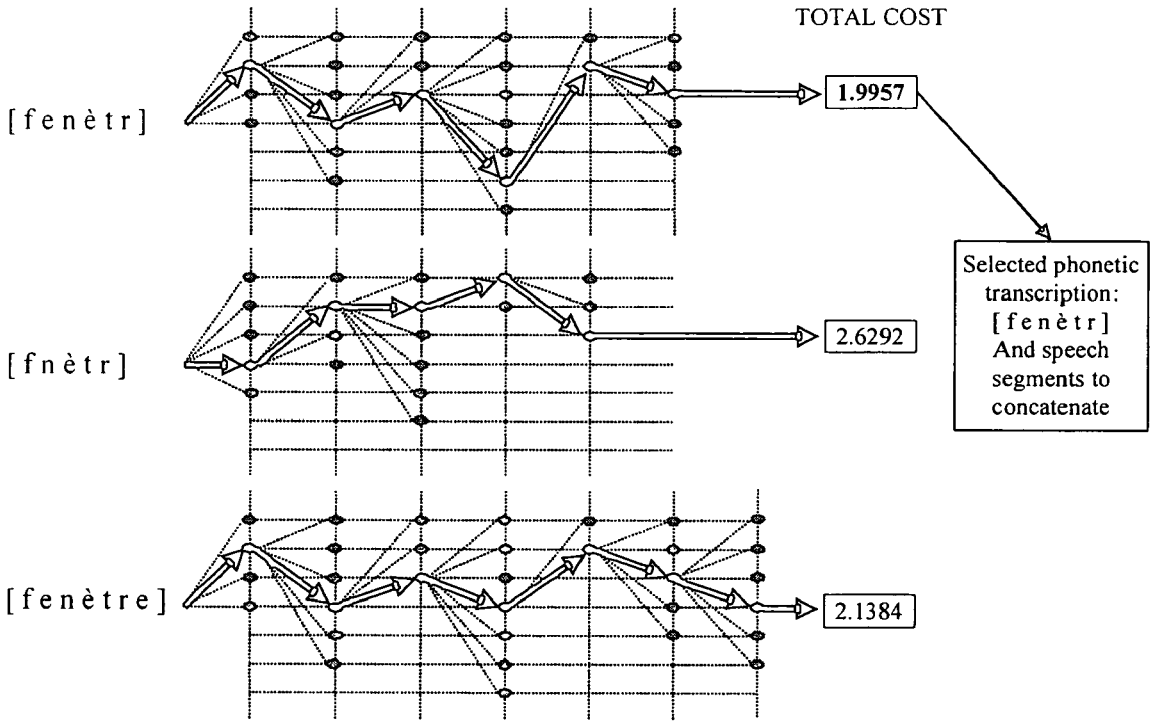
FIG. 5 exemplifies the preferred segments selection in a one-pass approach.

For each unit selection as pointed by a different letter in the example of FIG. 3, several segments are costed and selected given the previously selected candidates (if any). For each segment a concatenated cost is computed by the cost function and the ones that have the lowest costs are added to a grid of candidate segments. The cost function is based on several criteria which are tunable, (e.g. they can be weighted differently). For instance, if phonetic duration is deemed very important, a high weight to this criterion will penalize the choice of segments which have duration very different from the targeted duration.

Next, at step 212, the best/preferred path is selected, which in the preferred embodiment is the one that yields the overall lowest cost. The segments aligned to this path are then kept. Once the algorithm has found the best path among the several possibilities, all selected speech samples are concatenated at step 214 using standard signal processing techniques to finally produce synthetic speech at step 216. The best possible quality of the synthetic speech is achieved when the search algorithm successfully limits the amount of signal processing applied to the speech samples. If the phonetic transcriptions used to synthesize a sentence are the same as those that were actually used by the speaker during recordings, the dynamic programming search algorithm will likely find segments in similar contexts and ideally contiguous in the speaker database. When two segments are contiguous in the database, they can be concatenated smoothly, as almost no signal processing is involved in joining them. Avoiding or limiting the degradation introduced by signal processing leads to better signal quality of the synthesized speech. Providing several alternate candidate phonetic transcriptions to the search algorithm increases the chances of selecting best-matching speaker's segments, since those will exhibit lower concatenation costs.

To read more details on the concatenation and production of synthetic speech, the person skilled in the art can refer to "Current status of the IBM Trainable Speech Synthesis System", R. Donovan, A. Ittycheriah, M. Franz, B. Ramabhadran, E. Eide, M. Viswanathan, R. Bakis, W. Hamza, M. Picheny, P. Gleason, T. Rutherfoord, P. Cox, D. Green, E. Janke, S. Revelin, C. Waast, B. Zeller, C. Guenther, and S. Kunzmann, Proc. of the 4th ISCA Tutorial and Research Workshop on Speech Synthesis, Edinburgh, Scotland, 2001 and to "Recent improvements to the IBM Trainable Speech Synthesis System", E. Eide, A. Aaron, R. Bakis, P. Cohen, R. Donovan, W. Hamza, T. Mathes, J. Ordinas, M. Polkosky, M. Picheny, M. Smith, and M. Viswanathan, Proc. of the IEEE Int. Conf. on Acoustics, Speech, and Signal Processing, Hong Kong, 2003. Front-End.

It is to be noted that two methods of selecting the most appropriate phonetic transcriptions may be used: a first pass method or a one-pass selection method, now detailed.

The first pass method consists of running the search algorithm in a first pass only to perform the phonetic transcription selection. The principle is to favor the phonetic criterion in the cost function, e.g. by setting a zero (or extremely small) weight to the other criteria in order to emphasize the phonetic constraints. This method maximizes the chances of choosing a phonetic form identical or very close to the ones used by the speaker during recordings. For each phonetic form provided by the Front-End for a word, different paths are evaluated as shown on FIG. 4-*a*. The best paths of all the phonetic forms are compared and the very best one is the phonetic transcription retained for the further speech segments selection (step 212). Once the phonetic transcription is chosen, the TTS engine goes on in a second pass with the usual speech segments search given the result of this first pass as shown on FIG. 4-*b*.

The second approach, the 'one pass selection', allows the selection of the appropriate phonetic form amongst multiple phonetic transcriptions by introducing them into the usual search step. The principle is mainly the same as the previous method except that only one search pass is conducted and no parameters of the cost function are strongly favored. All parameters of the cost function are tuned to reach the best tradeoff in the choice of segments between the phonetic forms and the other constraints. If a speaker has pronounced a word in different manner during recordings, the choice of the best suitable phonetic transcription may be helped by the other constraints like the pitch, duration, and type of sentence. This is illustrated in FIG. 4. For instance, here are two French sentences with the same word 'fenêtre' pronounced differently:

(1) Lafenêtre est ouverte.

with the word 'fenêtre' pronounced [f e n è t r], and (2) Ferme lafenêtre!

with the word 'fenêtre' pronounced [f n è t r].

The first sentence is affirmative while the second one is exclamatory. These sentences differ in pitch contour, duration and energy. During synthesis this information may help to select the appropriate phonetic form because it will be easier for the search algorithm to find speech segments close to the predicted pitch, duration and energy in sentences of a matching type, for example.

In this implementation, the phonetic transcription selection is done at the same time as the speech unit's selection. Then the segments are concatenated to produce the synthesized speech.

It will be appreciated that the present invention may be realized in hardware, software, or a combination of hardware and software. The present invention may be realized in a centralized fashion in one computer system or in a distributed fashion where different elements are spread across several interconnected computer systems. Any kind of computer system or other apparatus adapted for carrying out the methods described herein is suited. A typical combination of hardware and software may be a general purpose computer system with a computer program that, when being loaded and executed, controls the computer system such that it carries out the methods described herein.

The present invention also may be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention may be embodied in other forms without departing from the spirit or essential attributes thereof. Accordingly, reference should be made to the following claims, rather than to the foregoing specification, as indicating the scope of the invention.

The invention claimed is:

1. At least one computer readable storage device storing instructions that, when executed on at least one processor, perform a method of selecting a preferred phonetic transcription for use in text-to-speech synthesizing an input text, the method comprising:

generating a plurality of phonetic transcriptions for at least one word of the input text to be synthesized, each of the plurality of phonetic transcriptions corresponding to a respective pronunciation that is of the at least one word as a whole, and is different from at least one other pronunciation corresponding to at least one other of the plurality of phonetic transcriptions;

computing at least one concatenative cost score for each one of the plurality of phonetic transcriptions to create a plurality of concatenative cost scores, the at least one concatenative cost score for each one of the plurality of phonetic transcriptions indicating at least one cost of concatenating selected speech segments from a plurality of stored speech segments associated with the respective one of the plurality of phonetic transcriptions; and selecting the preferred phonetic transcription from the plurality of phonetic transcriptions for use in text-to-speech synthesizing the at least one word based, at least in part, on the at least one concatenative cost score associated with the preferred phonetic transcription.

2. The at least one computer readable storage device of claim 1, wherein selecting the preferred phonetic transcription includes selecting a phonetic transcription having a lowest concatenative cost score from the plurality of concatenative cost scores.

3. The at least one computer readable storage device of claim 1, wherein the method further comprises:

selecting from the plurality of stored speech segments a sequence of speech segments associated with the preferred phonetic transcription; and concatenating the selected sequence of speech segments to text-to-speech synthesize the at least one word.

4. The at least one computer readable storage device of claim 3, wherein the sequence of speech segments is selected based at least in part on the at least one concatenative cost score associated with the preferred phonetic transcription.

5. The at least one computer readable storage device of claim 3, wherein the at least one concatenative cost score associated with the preferred phonetic transcription comprises a first set of one or more concatenative cost scores for the preferred phonetic transcription, and wherein selecting the sequence of speech segments comprises:

computing a second set of one or more concatenative cost scores for the preferred phonetic transcription; and selecting the sequence of speech segments based at least in part on the second set of one or more concatenative cost scores.

6. The at least one computer readable storage device of claim 5, wherein the first set of one or more concatenative cost scores is computed using a first concatenative cost function that favors at least one phonetic criterion, and the second set of one or more concatenative cost scores is computed using a second concatenative cost function that does not favor the at least one phonetic criterion.

7. The at least one computer readable storage device of claim 1, wherein the plurality of concatenative cost scores are computed using a concatenative cost function that favors at least one phonetic criterion.

8. The at least one computer readable storage device of claim 7, wherein the concatenative cost function comprises at least one prosody criterion.

9. The at least one computer readable storage device of claim 8, wherein the concatenative cost function comprises at least one pitch criterion, at least one duration criterion and/or at least one energy criterion.

10. A system for selecting a preferred phonetic transcription for use in synthesizing speech from an input text, the system comprising:

at least one storage medium storing a plurality of speech segments that may be concatenated to synthesize speech;

at least one input to receive the input text; and at least one computer coupled to the at least one input and capable of accessing the at least one storage medium, the at least one computer programmed to:

generate a plurality of phonetic transcriptions for at least one word of the input text to be synthesized, each of the plurality of phonetic transcriptions corresponding to a respective pronunciation that is of the at least one word as a whole, and is different from at least one other pronunciation corresponding to at least one other of the plurality of phonetic transcriptions;

compute at least one concatenative cost score for each one of the plurality of phonetic transcriptions to create a plurality of concatenative cost scores, the at least one concatenative cost score for each one of the plurality of phonetic transcriptions indicating at least one cost of concatenating selected speech segments from the stored plurality of speech segments associated with the respective one of the plurality of phonetic transcriptions; and select the preferred phonetic transcription from the plurality of phonetic transcriptions for use in text-to-speech synthesizing the at least one word based, at least in part, on the at least one concatenative cost score associated with the preferred phonetic transcription.

11. The system of claim 10, wherein the at least one computer is programmed to select as the preferred phonetic transcription a phonetic transcription having a lowest concatenative cost score from the plurality of concatenative cost scores.

12. The system of claim 10, wherein the at least one computer is further programmed to:

select from the plurality of speech segments a sequence of speech segments associated with the preferred phonetic transcription; and concatenate the selected sequence of speech segments to text-to-speech synthesize the at least one word.

13. The system of claim 12, wherein the at least one computer is programmed to select the sequence of speech segments based at least in part on the at least one concatenative cost score associated with the preferred phonetic transcription.

14. The system of claim 12, wherein the at least one concatenative cost score associated with the preferred phonetic transcription comprises a first set of one or more concatenative cost scores for the preferred phonetic transcription, and wherein the at least one computer is programmed to select the sequence of speech segments by:

computing a second set of one or more concatenative cost scores for the preferred phonetic transcription; and selecting the sequence of speech segments based at least in part on the second set of one or more concatenative cost scores.

15. The system of claim 14, wherein the at least one computer is programmed to compute the first set of one or more concatenative cost scores using a first concatenative cost function that favors at least one phonetic criterion, and to compute the second set of one or more concatenative cost scores using a second concatenative cost function that does not favor the at least one phonetic criterion.

16. The system of claim 10, wherein the at least one computer is programmed to compute the plurality of concatenative cost scores using a concatenative cost function that favors at least one phonetic criterion.

17. The system of claim 16, wherein the concatenative cost function comprises at least one prosody criterion.

18. The system of claim 17, wherein the concatenative cost function comprises at least one pitch criterion, at least one duration criterion and/or at least one energy criterion.

19. The system of claim 10, wherein the at least one storage medium includes a speaker database storing speech segments previously recorded from a speaker.

* * * * *